US012655623B2

(12) United States Patent
Krause

(10) Patent No.: US 12,655,623 B2
(45) Date of Patent: Jun. 16, 2026

(54) BRACKET ASSEMBLY, SHIM MEMBER FOR USE WITH A BRACKET MEMBER AND METHODS OF ASSEMBLY AND USE

(71) Applicant: Advanced Architectural Products, LLC, Allegan, MI (US)

(72) Inventor: G. Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 245 days.

(21) Appl. No.: 18/518,174

(22) Filed: Nov. 22, 2023

(65) Prior Publication Data

US 2024/0167265 A1 May 23, 2024

Related U.S. Application Data

(60) Provisional application No. 63/427,431, filed on Nov. 22, 2022.

(51) Int. Cl.
*E04B 1/24* (2006.01)

(52) U.S. Cl.
CPC .... *E04B 1/2403* (2013.01); *E04B 2001/2415* (2013.01)

(58) Field of Classification Search
CPC ..... E04B 1/2403; E04B 2001/2415; E04B 2001/389; E04F 13/25; E04F 13/24; E04F 13/007; F16B 33/004; F16B 43/001
USPC ..... 248/200, 205.3
See application file for complete search history.

(56) References Cited

U.S. PATENT DOCUMENTS

| | | | | |
|---|---|---|---|---|
| 2,028,615 | A * | 1/1936 | Lenke | E04D 3/08 52/395 |
| 3,201,109 | A * | 8/1965 | Sweeney | F16F 1/362 248/633 |
| 4,581,868 | A * | 4/1986 | McCann | E06B 3/66 52/204.593 |
| 5,100,096 | A * | 3/1992 | Mizuno | B65D 81/07 248/630 |
| 5,771,990 | A * | 6/1998 | Liang | F16F 7/00 248/677 |
| 6,536,729 | B1 * | 3/2003 | Haddock | E04D 3/362 52/204.55 |
| 8,826,620 | B2 * | 9/2014 | Krause | E04F 13/0875 52/489.1 |
| 8,833,025 | B2 * | 9/2014 | Krause | E04B 1/7629 52/489.1 |
| 10,221,573 | B2 * | 3/2019 | Krause | E04F 13/0803 |
| 11,066,832 | B2 * | 7/2021 | Krause | E04B 1/7629 |
| 2014/0175256 | A1 * | 6/2014 | Sugita | F16M 11/20 156/60 |

(Continued)

FOREIGN PATENT DOCUMENTS

| | | | |
|---|---|---|---|
| CN | 109208850 | B | 3/2024 |
| DE | 8915332 | U1 | 4/1990 |

*Primary Examiner* — Muhammad Ljaz
(74) *Attorney, Agent, or Firm* — The Watson IP Group; Jovan N. Jovanovic

(57) ABSTRACT

A bracket assembly comprising a bracket member and a shim member. The bracket member can be attached to an outside surface with a shim member being positioned therebetween. The configuration of the shim member is likewise disclosed, as is a method of assembling the bracket assembly, a method of assembling the shim member and methods of use are likewise disclosed.

19 Claims, 4 Drawing Sheets

(56) References Cited

U.S. PATENT DOCUMENTS

| | | | | |
|---|---|---|---|---|
| 2015/0122969 | A1* | 5/2015 | Sugita | F16F 15/08 248/562 |
| 2015/0225975 | A1* | 8/2015 | Sugita | F16F 15/02 52/167.1 |
| 2018/0347196 | A1* | 12/2018 | Stearns | E04D 1/30 |
| 2022/0243463 | A1* | 8/2022 | Krause | E04F 13/0817 |
| 2022/0298779 | A1* | 9/2022 | Krause | E04F 13/0857 |
| 2024/0167265 | A1* | 5/2024 | Krause | E04F 13/24 |
| 2025/0101734 | A1* | 3/2025 | McCorriston | E04B 1/3483 |
| 2025/0270872 | A1* | 8/2025 | Baier | E06B 1/6069 |

* cited by examiner

BRACKET ASSEMBLY, SHIM MEMBER FOR USE WITH A BRACKET MEMBER AND METHODS OF ASSEMBLY AND USE

CROSS-REFERENCE TO RELATED APPLICATION

This application claims priority from U.S. Prov. Patent App. Pub. No. 63/427,431, entitled "Bracket Assembly, Shim Member For Use With A Bracket Member And Methods Of Assembly And Use" filed Nov. 22, 2022, the entire disclosure of which is incorporated by reference herein in its entirety.

BACKGROUND OF THE DISCLOSURE

1. Field of the Disclosure

The disclosure relates in general to building products, and more particularly, to a bracket assembly having a bracket member and a shim member, a shim member for use with a bracket member and also method of both assembling the bracket assembly and using the bracket assembly and the shim member.

2. Background Art

The use of bracket members is known in the art. The bracket members are often utilized to extend between cladding on the one side and the outer side of a building or other surface on the other side. Typically, the bracket member provides adequate space for the receiving of insulation and the like.

In some installations, it will be understood that there are variations in an outer surface to which the bracket member is to be coupled. Additionally, with the bracket member being formed from a metal member, the heat conduction is quite high. There is a desire to improve the performance of the bracket member, and also to allow the bracket member to adapt to surface variations in outside surfaces to which the bracket members are to be attached.

SUMMARY OF THE DISCLOSURE

The disclosure is directed, in one aspect, to a bracket assembly for attachment to an outside surface. The bracket assembly comprising a body wall, a first end wall and a second end wall. The body wall has a top edge and a bottom edge opposite the top edge, and a front and a back opposite the front. The first end wall extends from the bottom edge and is substantially perpendicular to the body wall. The first end wall extends away from the front of the body wall, with the first end wall including a lower surface The second end wall extends from the top edge and substantially perpendicular to the body wall. The second wall extends away from the back of the body wall so that the first end wall and the second end wall extend substantially in opposite directions relative to each other and the body wall. Each shim member includes a body, an upper seal layer, a lower seal layer and a fastener opening. The body has a top side and a bottom side. The upper seal layer extends over the top side, and is more flexible than the body. The lower seal layer extends over the bottom side, and is more flexible than the body. A fastener opening is defined through the body, the upper seal layer and the lower seal layer, wherein a portion of each of the upper seal layer and the lower seal layer surround the fastener opening. The upper seal layer of each of the at least one shim member engages the lower surface of the first end wall with the upper seal layer sealingly engages the lower surface of the first end wall about the fastener opening. The lower seal layer of each of the at least one shim member is structurally configured to engage an outside surface sealingly engaging the outside surface about the fastener opening. A fastener is structurally configured to be extendable through the first end wall, the fastener opening and into the outside surface.

In some configurations, the bracket member comprises a metal member, and the at least one shim member comprises a polymer member.

In some configurations, the at least one shim member comprises a plurality of shim members positioned along the lower surface of the second end wall in a spaced apart orientation.

In some configurations, each of the at least one shim members defines a thickness. At least one of the at least one shim members has a different thickness than at least one other of the at least one shim members.

In some configurations, the first end wall includes a plurality of fastener openings. The fastener opening of at least one of the at least one shims aligns with one of the plurality of fastener openings of the first end wall.

In some configurations, each of the at least one shim members having the fastener opening align with one of the plurality of fastener openings of the first end wall.

In some configurations the at least one shim member further includes at least one front clip and at least one back clip. The at least one front clip extends inwardly from the top side of the body at a front thereof so as to overlie a portion of the upper seal layer and so as to define a receiving slot with the upper seal layer. The at least one back clip extends upwardly from the top side of the body at a back thereof. The at least one back clip has an inward connector at a distal end of the at least one back clip. The inward connector overlies the top seal layer. The bracket member further includes at least one opening defined in the body wall spaced apart from the bottom edge thereof. The at least one opening is structurally configured to receive the inward connector therethrough when the at least one shim member is operably positioned relative to the bracket member. A portion of a front edge of the first end wall is structurally configured to be captured within the receiving slot, to, in turn releasably lock the at least one shim member to the bracket member.

In some configurations, the at least one front clip comprises a pair of front clips that are spaced apart from each other.

In some configurations, the body wall of the bracket member further includes a plurality of thermal openings extending therethrough, the thermal openings being spaced apart from the first end wall and the second end wall.

In another aspect of the disclosure, the disclosure is directed to a shim member for use in a bracket assembly. The shim member comprises a body, an upper seal layer and a lower seal layer. The body has a top side and a bottom side. The upper seal layer extends over the top side, and is more flexible than the body. The lower seal layer extends over the bottom side, and is more flexible than the body. The fastener opening is defined through the body, the upper seal layer and the lower seal layer, wherein a portion of each of the upper seal layer and the lower seal layer surround the fastener opening. The upper seal layer of each of the at least one shim member is structurally configured to engage an end wall of a bracket member with the upper seal layer sealingly engages the end wall about the fastener opening. The lower seal layer of each of the at least one shim member is structurally configured to engage an outside surface sealingly engaging the outside surface about the fastener opening.

In some configurations, the top side and the bottom side are substantially parallel to each other.

In some configurations, the body is a rectangular cubic configuration.

In some configurations, the body is made of a polymer member, with each of the upper seal layer and the lower seal layer comprising a more flexible polymer member.

In some configurations, the body comprises a rigid member.

In some configurations, the upper seal layer covers the entirety of the top side of the body.

In some configurations, the lower seal layer covers the entirety of the bottom side of the body.

In some configurations, at least one front clip extends inwardly from the top side of the body at a front thereof so as to overlie a portion of the upper seal layer and so as to define a receiving slot with the upper seal layer. Additionally, at least one back clip extends upwardly from the top side of the body at a back thereof. The at least one back clip has an inward connector at a distal end of the at least one back clip. The inward connector overlying the top seal layer.

In some configurations, the at least one front clip comprises a pair of front clips that are spaced apart from each other.

In another aspect of the disclosure, the disclosure is directed to a method of attaching the bracket assembly described herein to an outside surface, and comprises the steps of: positioning the upper seal layer into engagement with the lower surface of the first end wall; positioning the bracket assembly on an outside surface so that the lower seal layer is in engagement with the outside surface; providing a fastener; and extending the fastener through the first end wall, the fastener opening of the at least one shim member and into the outside surface.

In some configurations, each of the foregoing steps are repeated for each of the at least one shim members.

BRIEF DESCRIPTION OF THE DRAWINGS

The disclosure will now be described with reference to the drawings wherein.

Figure 1:
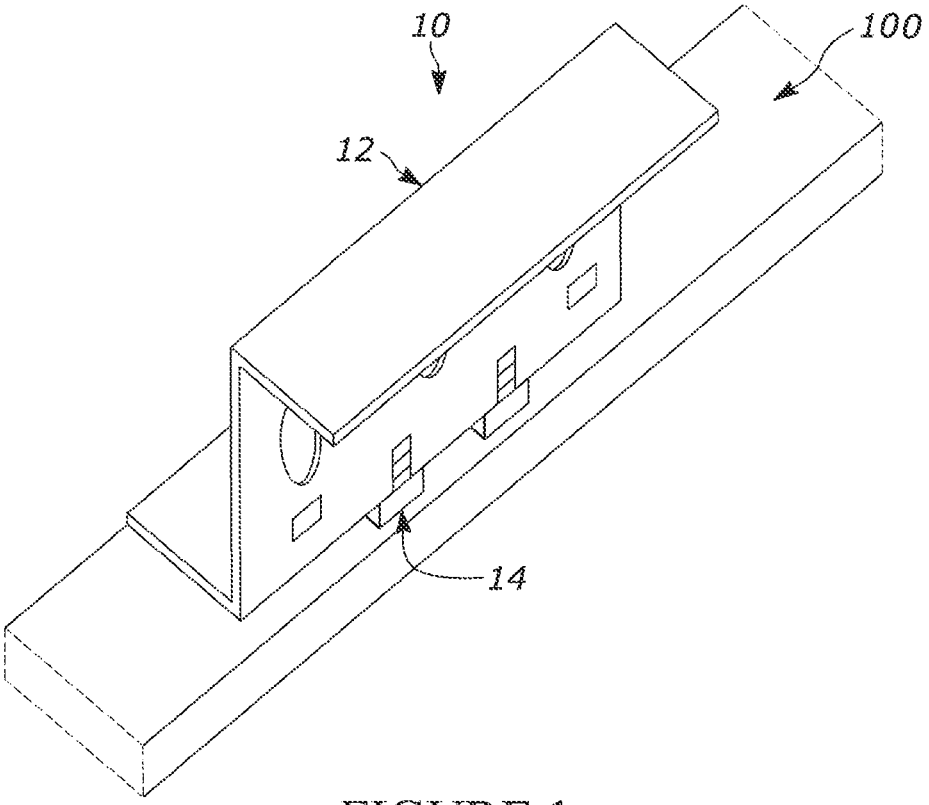
FIG. 1 of the drawings is a perspective view of the bracket assembly of the present disclosure coupled to an outside surface.

An appendix of additional figures is attached as well and incorporated herein.

DETAILED DESCRIPTION OF THE DISCLOSURE

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
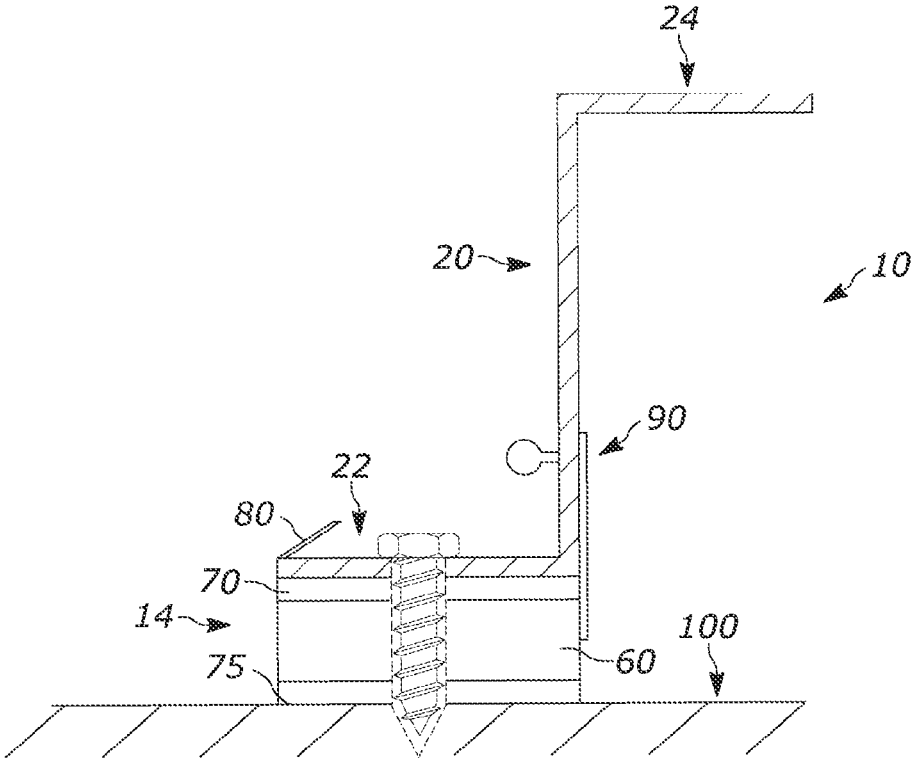
FIG. 2 of the drawings is a side elevational view of the bracket assembly of the present disclosure coupled to an outside surface.
Figure 3:
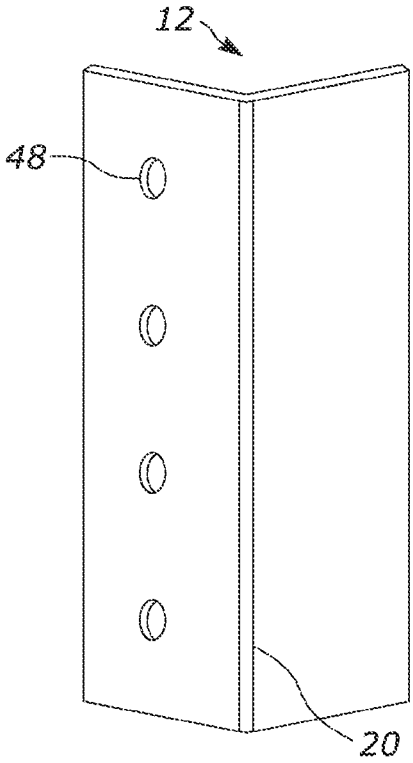
FIG. 3 of the drawings is a top plan view of the bracket member.
Figure 4:
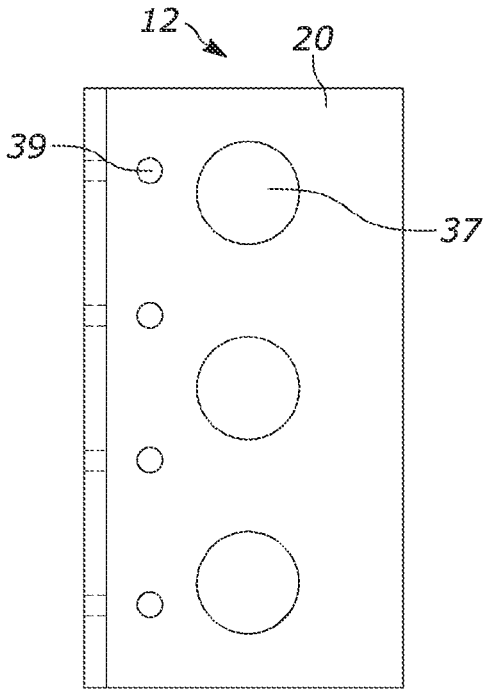
FIG. 4 of the drawings is a front elevational view of the bracket member.
Figure 5:
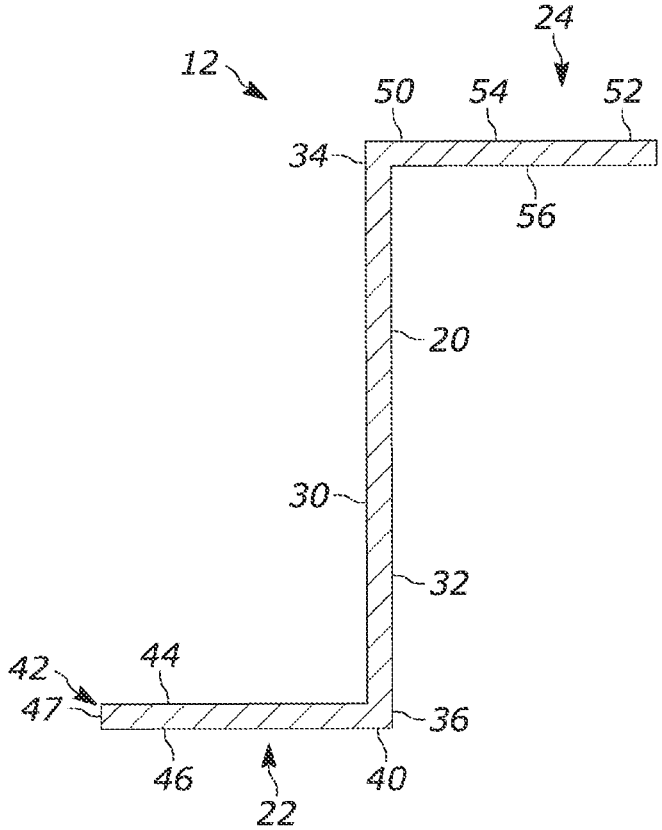
FIG. 5 of the drawings is a side elevational view of the bracket member.
Figure 6:
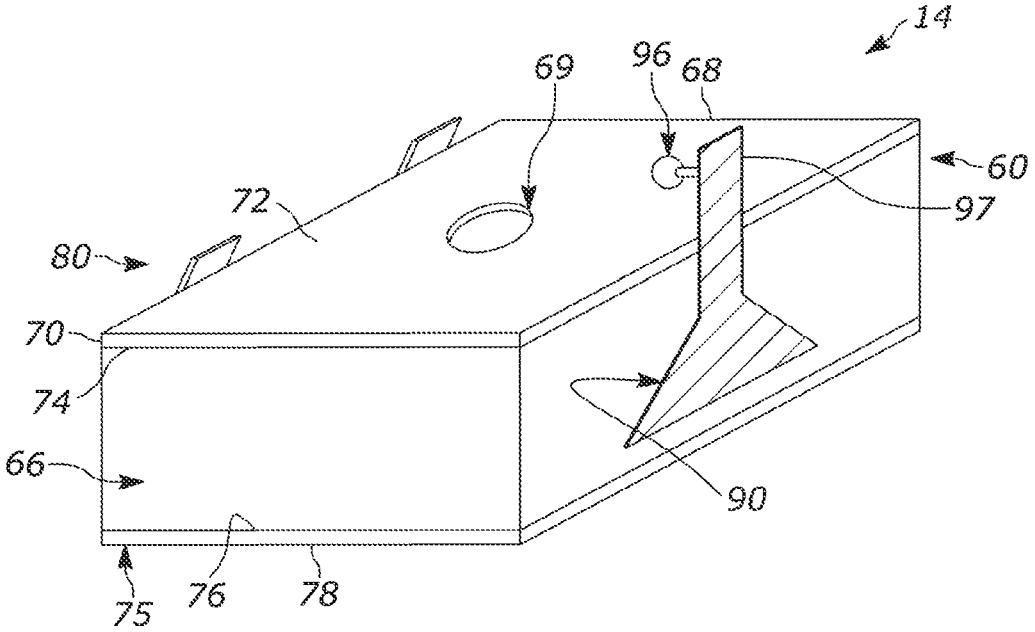
FIG. 6 of the drawings is a perspective view of the shim member of the present disclosure.
Figure 7:
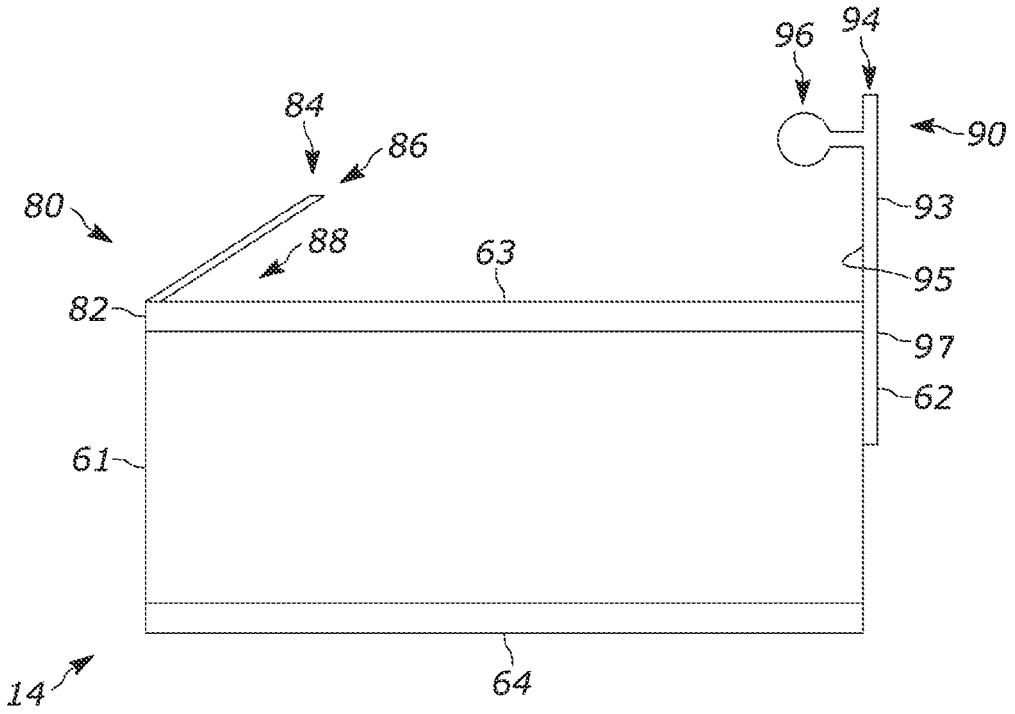
FIG. 7 of the drawings is a side elevational view of the shim member of the present disclosure.

Referring now to the drawings and in particular to FIGS. 1 and 2, a bracket assembly is shown generally at 10. The bracket assembly 10 includes bracket member 12 and a plurality of shim members, such as shim member 14. It will be understood that the bracket assembly is generally utilized in association with a building structure, and may be configured for installation on an outside surface, such as surface 100. Such bracket members (often referred to as girts), are often utilized in buildings so as to provide spacing between an outside of a building structure and cladding to allow for insulation therebetween, around windows, and about other structures of a building. The particular disclosure is not limited to use in association with any part of a building or with any particular other structures of a building.

With reference to FIGS. 2 through 6, the bracket member 12 is shown as comprising what is often known as a z-girt, that includes a body wall 20, a first end wall 22 and a second end wall 24. Typically, the first and second end walls are parallel or substantially parallel (i.e., +/−10°) to each other, with the body wall being perpendicular or substantially perpendicular (i.e., +/−10°) to either. Additionally, the first and second walls extend from the body wall in opposite directions (while variations are contemplated). Generally, the bracket member 12 is formed of a metal material, such as steel, or stainless steel, or galvanized steel, among other materials. Often, the bracket member is formed from sheet metal that undergoes a stamping or other forming process.

The body wall 20 of the bracket member includes front 30, back 32, top edge 34, bottom edge 36. It will be understood that the different regions are identified as top and bottom, front and back, with the understanding that the bracket member may be oriented vertically, horizontally or somewhere between vertically and horizontally, without limitation, and that the components herein identified as a top edge may be below the bottom edge, and the like, as these are relative descriptions of the configuration as shown in the Figures, and not to be deemed as being limiting to a particular orientation of the bracket member.

The body wall 20 may include a plurality of thermal openings 37 that are formed therethrough. Additionally, a plurality of retaining openings may be disposed at regular intervals (or irregular intervals) in a spaced apart orientation closer to the bottom edge 36. As will be explained below, these retaining openings are configured to receive inward connectors 96 of the shim member 14.

The first end wall 22 extends from front 30 of the body wall proximate bottom edge 36 thereof. The first end wall includes proximal end 40 at the bottom edge 36 and distal end 42 spaced apart therefrom, defining edge 47, as well as, upper surface 44 and lower surface 46. A plurality of fastener openings extend through the first end wall and are disposed along the length thereof, spaced apart from each other, and generally spaced apart from the proximal an distal ends of the first end wall. In some configurations, the position of the fastener openings may correspond to the position of the retaining openings 39 of the body wall 20.

The second end wall 24 extends from the back 32 of the body wall proximate the top edge 34 thereof. The second end wall includes proximal end 50 at the top edge 34 and distal end 52 spaced apart therefrom. The second end wall further includes an upper surface 54 and a lower surface 56 opposite the upper surface.

The shim member 14 is shown in FIGS. 1, 2, 6 and 7 as comprising body 60, upper seal layer 70, lower seal layer 75, front clip 80 and back clip 90. It will be understood that the assembly may include a bracket member and a plurality of shim members which can be coupled to the bracket member. The shim members may be identical, or may be varied structurally as well as dimensionally. That is, the different shim members may have a different height (of the body), may have a different width, may include certain features or may omit certain features.

The body 60 of the shim member 14 is defined by front side 61, back side 62, top side 63, bottom side 64 and first and second spanning sides 66, 68. A fastener bore 69 extends through the body 60 from the top side 63 to the bottom side 64. In some configurations, the opposing sides are parallel to each other and perpendicular to intersecting sides so as to form a rectangular cubic configuration. In other configurations, the different sides may define planes, and the planes may intersect oblique to each other so as to form other types of configurations. It is additionally contemplated that the different sides may be arcuate in one or more directions (i.e., cylindrical, spherical, among other configurations). For example, the body may have a cross section that is substantially uniform between the top side 63 and the bottom side 64. In other configurations, the body may have varying cross sectional configurations between the top side and the bottom side, or, between the front side and the back side, or, between the first and second spanning sides.

The body 60 may comprise an extruded component, a injection molded component, among other configurations. The body preferably comprises a rigid polymer which may or may not be fiber reinforced.

The upper seal layer 70 is shown as overlying the top side 63 and comprises a polymer layer that has a relatively lower durometer polymer as compared to the body 60, defining upper surface 72 and lower surface 74. The upper seal layer 70 is configured to be compressed so as to provide a fluid tight seal about the fastener bore 69 and the first end wall 22. In the configuration shown, the upper seal layer 70 generally corresponds in shape to the top side 63. In other configurations, the upper seal layer 70 may comprise hoop or other shape extending about the fastener bore 69 so as to seal the fastener bore, without corresponding to the top side 63.

The lower seal layer 75 is shown as overlying the bottom side 64 of the body 60 and similarly comprises a polymer layer that has a relatively lower durometer polymer as compared to the body 60, defining upper surface 76 and lower surface 78. The lower seal layer 75 is configured to be compressed so as to provide a fluid tight seal about the fastener bore 69 and the outside surface 100. As with the upper seal layer, the lower seal layer 75 may correspond in shape to the bottom side 64. In other configurations, the lower seal layer 75 may comprise a hoop or other shape extending about the fastener bore 69 so as to seal the fastener bore, without corresponding to the bottom side 64.

It will be understood that in some configurations, the upper and lower seal layers may be co-molded with the body 60, or may be sealed thereto through heat, ultrasonics, RF welding, among other manners, or may be otherwise adhered to the body 60. In other configurations, it is contemplated that in the field, an operator applies a bead of a flexible material (such as a silicone, or other polymer or adhesive from a tube or aerosol can, for example) on one or more of the top surface and the bottom surface prior to assembly, to provide the above-described seal and so as to preclude the passage of moisture, fluid and other debris into the fastener bore (which can accelerate the corrosion of the bracket member as well as the fasteners extending through the fastener bore.

The front clip 80 is shown as comprising base 82 and extension 84. The base 82 may be positioned over a portion of the front side 61 of the body 60. The extension 84 extends outwardly and inwardly overlying a portion of the top side 63 and terminating at a distal end 86. The extension 84 cooperating with the top side 63 so as to define a receiving slot 88. In some configurations, the front clip 80 may comprise s metal member which is attached to the body 60 through fasteners, or other mechanical couplings (interference, slot/tab, snap fit, etc.), as well as through adhesion, co-molding, welding or other processes. In other configurations, the front clip 80 may comprise a polymer member which is separate from the body 60 and which is attached through any of the foregoing attachment processes and couplings, or which may be integrally formed with the body 60 (from the same or from compatible polymers). In such a configuration, the base 82 is unitized with the front side 61 of the body. It will be understood that a single front clip may be utilized, or, multiple front clips may be positioned in a spaced apart orientation. The front clips may be of the same width or may be of varying width.

The back clip 90 is shown as comprising base 92 and extension 93. The base 92 may be positioned over back side 62 of the body 60. The extension 93 extends from the base and away from the top side 63, terminating in a distal end 94. The extension further includes an inner surface 95 and an outer surface 97. The inner surface 95 is configured to extend along and/or proximate the back 32 of body wall 20, and includes an inward connector 96 extending therefrom. In come configurations, multiple inward connectors may be utilized. In some configurations, the back clip 90 may comprise s metal member which is attached to the body 60 through fasteners, or other mechanical couplings (interference, slot/tab, snap fit, etc.), as well as through adhesion, co-molding, welding or other processes. In other configurations, the back clip 90 may comprise a polymer member which is separate from the body 60 and which is attached through any of the foregoing attachment processes and couplings, or which may be integrally formed with the body 60 (from the same or from compatible polymers). In such a configuration, the base 92 is unitized with the back side 62 of the body.

To assemble the bracket assembly 10, the bracket member 12 is provided. The bracket member may be of any length, although typically, such a bracket member is typically 16' or shorter (while not limited thereto). Once the bracket member is provided, a plurality of shim members may be provided. For example, an entire kit of shim members of varying sizes may be provided from which the user can select the desired ones of the shims. Where the outer surface has variation, it may be necessary to utilize a plurality of differently sized (i.e., different thicknesses) shims for use.

Once provided, the shim members may be coupled to the bracket member prior to introducing the bracket assembly to the outside surface. In other configurations, the shims may be introduced one by one as the bracket assembly is attached to the outside surface. Of course, combinations of the foregoing are likewise contemplated.

To couple a shim member to the bracket member, the shim member is positioned so that the edge 47 of the first end wall of bracket member 12 can be inserted into the receiving slot 88 and directed toward the junction of the extension 84 and the top side 63 of the shim member. Once positioned, the first end wall can be directed toward the top side 63 of the shim member and eventually, the back clip (and, likely, the inward connector 96) contacts the back 32 of the body wall 20. The shim member can be slidably directed along the bracket member until the inward connector meets a retaining opening 39 along the back of the body wall, and engages the same. Once engaged, the shim member is releasably coupled to the bracket member. Additionally, when engaged, the fastener opening 48 of the first end wall aligns with the fastener bore 69 of the body of the shim member 14.

The user can then drive a fastener, such as a threaded fastener, a nail, or the like through the fastener opening 48 and through the fastener bore 69 of the body of the shim member into the outer surface 100. As the fastener is tightened, the upper and lower seal layers compress so as to form a fluid tight (or substantially fluid tight) seal about the fastener bore. If a sealing washer is utilized with the fastener, the fastener bore is fully sealed. This process can be repeated sequentially for each of the shim members, or the shim members may first be coupled to the bracket member at the desired spaced apart configuration and so as to align with the desired fastener openings. It will be understood that in other configurations, the upper and lower seal layers can be eliminated. Additionally, the front clip and back clip can be omitted in other configurations. In such configurations where the front clip and the back clip are omitted, the fastener opening is aligned with the fastener bore prior to directing the fastener through the fastener opening and the fastener bore.

Advantageously, the use of different shim members can adjust for imperfections and surface variations in an outside surface. Furthermore, as the shim members are formed from an insulative material (substantially lower heat conductivity and substantially higher insulative properties), the bracket members are isolated and provide a separation between the bracket member and the outside surface.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

The invention claimed is:

1. A bracket assembly for attachment to an outside surface, the bracket assembly comprising:

a bracket member including:

a body wall having a top edge and a bottom edge opposite the top edge, and a front and a back opposite the front;

a first end wall extending from the bottom edge and substantially perpendicular to the body wall, the first end wall extending away from the front of the body wall, with the first end wall including a lower surface;

a second end wall extending from the top edge and substantially perpendicular to the body wall, the second wall extending away from the back of the body wall so that the first end wall and the second end wall extend substantially in opposite directions relative to each other and the body wall;

at least one shim member, each of the at least one shim member including:

a body having a top side and a bottom side;

an upper seal layer extending over the top side, and being more flexible than the body;

a lower seal layer extending over the bottom side, and being more flexible than the body;

a fastener opening defined through the body, the upper seal layer and the lower seal layer, wherein a portion of each of the upper seal layer and the lower seal layer surround the fastener opening;

wherein the upper seal layer of each of the at least one shim member engages the lower surface of the first end wall with the upper seal layer sealingly engages the lower surface of the first end wall about the fastener opening; and wherein the lower seal layer of each of the at least one shim member is structurally configured to engage an outside surface sealingly engaging the outside surface about the fastener opening; and wherein a fastener is structurally configured to be extendable through the first end wall, the fastener opening and into the outside surface.

2. The bracket assembly of claim 1 wherein the bracket member comprises a metal member, and the at least one shim member comprises a polymer member.

3. The bracket assembly of claim 1 wherein the at least one shim member comprises a plurality of shim members positioned along the lower surface of the second end wall in a spaced apart orientation.

4. The bracket assembly of claim 3 wherein each of the at least one shim members defines a thickness, wherein at least one of the at least one shim members has a different thickness than at least one other of the at least one shim members.

5. The bracket assembly of claim 1 wherein the first end wall includes a plurality of fastener openings, wherein the fastener opening of at least one of the at least one shims aligns with one of the plurality of fastener openings of the first end wall.

6. The bracket assembly of claim 5 wherein each of the at least one shim members having the fastener opening align with one of the plurality of fastener openings of the first end wall.

7. The bracket assembly of claim 1 wherein:

the at least one shim member further includes:

at least one front clip extending inwardly from the top side of the body at a front thereof so as to overlie a portion of the upper seal layer and so as to define a receiving slot with the upper seal layer; and at least one back clip extending upwardly from the top side of the body at a back thereof, the at least one back clip having an inward connector at a distal end of the at least one back clip, the inward connector overlying the top seal layer;

the bracket member further includes at least one opening defined in the body wall spaced apart from the bottom edge thereof, the at least one opening structurally configured to receive the inward connector therethrough when the at least one shim member is operably positioned relative to the bracket member, while a portion of a front edge of the first end wall is structurally configured to be captured within the receiving slot, to, in turn releasably lock the at least one shim member to the bracket member.

8. The bracket assembly of claim 1 wherein the at least one front clip comprises a pair of front clips that are spaced apart from each other.

9. The bracket assembly of claim 1 wherein the body wall of the bracket member further includes a plurality of thermal openings extending therethrough, the thermal openings being spaced apart from the first end wall and the second end wall.

10. A shim member for use in a bracket assembly, the shim member comprising:

a body having a top side and a bottom side;

an upper seal layer extending over the top side, and being more flexible than the body;

a lower seal layer extending over the bottom side, and being more flexible than the body;

a fastener opening defined through the body, the upper seal layer and the lower seal layer, wherein a portion of each of the upper seal layer and the lower seal layer surround the fastener opening;

at least one front clip extending inwardly from the top side of the body at a front thereof so as to overlie a portion of the upper seal layer and so as to define a receiving slot with the upper seal layer; and at least one back clip extending upwardly from the top side of the body at a back thereof, the at least one back clip having an inward connector at a distal end of the at least one back clip, the inward connector overlying the top seal layer, wherein the upper seal layer of each of the at least one shim member is structurally configured to engage an end wall of a bracket member with the upper seal layer sealingly engages the end wall about the fastener opening; and wherein the lower seal layer of each of the at least one shim member is structurally configured to engage an outside surface sealingly engaging the outside surface about the fastener opening.

11. The shim member of claim 10 wherein the top side and the bottom side are substantially parallel to each other.

12. The shim member of claim 11 wherein the body is a rectangular cubic configuration.

13. The shim member of claim 10 wherein the body is made of a polymer member, with each of the upper seal layer and the lower seal layer comprising a more flexible polymer member.

14. The shim member of claim 13 wherein the body comprises a material that is more rigid than the flexible polymer member.

15. The shim member of claim 10 wherein the upper seal layer covers the entirety of the top side of the body.

16. The shim member of claim 15 wherein the lower seal layer covers the entirety of the bottom side of the body.

17. The shim member of claim 10 wherein the at least one front clip comprises a pair of front clips that are spaced apart from each other.

18. A method of attaching the bracket assembly of claim 1 to an outside surface comprising the steps of:

positioning the upper seal layer into engagement with the lower surface of the first end wall;

positioning the bracket assembly on an outside surface so that the lower seal layer is in engagement with the outside surface;

providing a fastener; and extending the fastener through the first end wall, the fastener opening of the at least one shim member and into the outside surface.

19. The method of claim 18 wherein each of the steps are repeated for each of the at least one shim members.

* * * * *